US005894977A

United States Patent [19]

Krueger et al.

[11] Patent Number: 5,894,977

[45] Date of Patent: Apr. 20, 1999

[54] BACKPACK APPARATUS

[75] Inventors: John A. Krueger, Brookfield; Ronald A. Perez, Shorewood, both of Wis.

[73] Assignee: Sparks International Inc., Brookfield, Wis.

[21] Appl. No.: 08/897,456

[22] Filed: Jul. 21, 1997

[51] Int. Cl.[6] ..... A45F 3/04

[52] U.S. Cl. ..... 224/627; 224/153

[58] Field of Search ..... 224/158, 159, 224/160–161, 155–156, 576, 625, 628, 633, 907, 275, 645, 652, 653; 297/283.2, 283.3, 284.2, 284.4, 284.5, 284.6; 601/15, 16, 19, 49, 56, 57, 58, 64, 78, 79, 80, 81, 124; 607/108, 112, 114; 150/113; 1980/103, 110; 2/467, 247

[56] References Cited

U.S. PATENT DOCUMENTS

| | | | |
|---|---|---|---|
| 4,159,020 | 6/1979 | Soiron . | |
| 4,995,436 | 2/1991 | Cantor | 150/113 |
| 5,038,779 | 8/1991 | Barry et al. | 128/402 |
| 5,179,942 | 1/1993 | Drulias et al. | 128/101.1 |
| 5,361,437 | 11/1994 | Zhu . | |
| 5,378,225 | 1/1995 | Chatman . | |
| 5,403,258 | 4/1995 | Hill . | |
| 5,405,068 | 4/1995 | Lovett | 224/275 |
| 5,429,585 | 7/1995 | Liang | 601/15 |
| 5,450,858 | 9/1995 | Zablotsky . | |
| 5,487,498 | 1/1996 | Gleason . | |
| 5,529,230 | 6/1996 | Smith . | |
| 5,534,021 | 7/1996 | Dovretzky | 607/112 |
| 5,547,461 | 8/1996 | Levis . | |
| 5,551,085 | 9/1996 | Leighton . | |
| 5,573,155 | 11/1996 | Sadler | 224/155 |

*Primary Examiner*—Allan N. Shoap
*Assistant Examiner*—Maerena W. Brevard
*Attorney, Agent, or Firm*—James A. Geppert

[57] ABSTRACT

A backpack assembly with top, bottom, front, primary back and side panels which together define a chamber within. A pair of shoulder straps are secured to the backpack such that, with the straps positioned over the shoulders of the person, the position of the front panel is generally parallel to the back of the person. The primary back panel is securely attached to a secondary back panel along the top edge and elastically attached along the sides forming a pocket in-between the back panels. When placed over the back chair rest, the pocket supports the backpack behind the chair. Thermal gradient pads and vibrational generation provide enhanced benefits of the backpack to the user.

18 Claims, 7 Drawing Sheets

BACKPACK APPARATUS

BACKGROUND OF THE INVENTION

I. The present invention relates to a backpack.

II. There are many previously known backpacks which have a front, top, bottom, side and back panels which as an assembly define the chamber within for carrying objects. A pair of shoulder straps are secured to the backpack so that when the backpack is worn, the backpack is supported on the back of the person. Such backpacks are of the type used by students for carrying academic supplies.

Sadler describes a backpack as described above and which has a pad assembly having a first and second generally planar pads, each having a top, bottom and two sides. The bottoms of the pads are pivotally secured together between a first position in which the first pad overlies and is substantially parallel to the second pad, and a second position in which the plane of the first pad is substantially perpendicular to the plane of the second pad. The top and sides of the first pad are secured to the top and sides of the second panel so that, with a back of a chair positioned in between the first pad and first panel, the chair supports the pack behind the back of the chair. Sadler describes how this design can be used to conveniently store the backpack in a classroom.

For the Sadler configuration, the pivotal pad assembly as positioned for transportation places the second pad which pivots onto the seat of the chair behind the first pad. In the transportation mode, the lumbar relief of the first pad interfaces with the second pad as pivoted behind it on the backpack. Because of the design, this position does not give the same lumbar relief benefits which is attained when the backpack is positioned over the back rest of the chair.

Secondly, the Sadler invention requires a design consisting of two cushioning pads which constitutes a dual padding assembly adding width to the backpack during transit. The additional bulk is attributed to the second pad pivoted behind the first pad.

Thirdly, the strapping mechanism which combines the pad assembly to the backpack requires sufficient clearance so that the second pad can pivot and fold behind the first pad. This clearance distance may not be ideal for the variations of desk seats and chairs within an academic environment. Therefore, alterations may be required to reposition the backpack from its transportation mode to its position on the back rest of the chair.

Finally, the preferred embodiment of the Sadler invention includes 2 straps; one at the top and one on each side. Each strap has a buckle mechanism which provides the ability for the pivotal pad assembly to be removed from the back side of the backpack. The mechanism for interfacing the pad assembly to the backpack and the dual pivotal pad assembly incur significant costs. The buckle mechanism also creates a potential of snag point of the pad assembly on the back rest of the chair when positioning the backpack in place.

SUMMARY OF THE INVENTION

The present invention provides a backpack assembly which overcomes all of the above-mentioned disadvantages of the previously known devices.

The backpack assembly comprises a front, primary back, top, bottom and two side panels. The assembly forms a chamber for carrying objects such as books or supplies needed within an academic setting. A zipper or other conventional means provides selective access to the chamber.

The backpack further includes a pair of shoulder straps which when positioned over the shoulders of the persons allows the front panel to be positioned generally parallel to the back of the patient.

The present invention further comprises a secondary back panel which is attached to the primary back panel on 3 sides forming a pocket in-between the back panels. In the preferred embodiment, the primary back panel is securely attached to the secondary back panel along the top seam and elastically attached along the edge seams to provide adaptability for the backpack to interface with the backs of chairs found in typical academic settings.

This invention further provides a low cost, low-profile backpack which provides the same lumbar relief during transportation as well as when positioned over the back rest of a chair. The invention further provides the ability to add pockets located between the back panels thereby providing a place for storing small objects or placing the user's hands when they're placed within the pockets while the backpack is worn.

Variations of the backpack enhance the backpack's utility to the user in various environments. One variation provides the ability of including a removable thermal gradient pad located within the lumbar support of the secondary back panel. This thermal gradient pad can either be of the type which sustains heat for an extended period of time or maintains cool temperatures for an extended period of time. This variation would especially be advantageous in extreme temperature environments. Another variation of the backpack includes vibrational generation through the primary back panel in the lumbar region. Pressure sensitive activation, random activation or manual control activation energizes the vibrational mechanism of the backpack.

OBJECTS OF THE INVENTION

An object of the invention is to provide a "low-profile" backpack of lightweight construction which has lumbar support designed into the back surface of the backpack thereby providing lumbar relief when the backpack is utilized in transit.

Another object of the invention is to provide a low-profile backpack which has lumbar support designed into the back surface of the backpack which interfaces over seating typically found in academic settings thereby providing lumbar relief when the backpack is placed over the back of the chair.

Another object of the invention is to provide a new and improved backpack which provides in the apparatuses and methods of the prior art lumbar relief while the backpack is positioned over the chair, but now also providing lumbar relief while the backpack is worn in transit while maintaining a significantly lower profile.

Another object of the invention is to provide the low-profile backpack in such a manner as when placed over the back of the chair provides a convenient way of storing the backpack and reducing clutter within academic settings.

Another object of the invention is to provide a backpack with lumbar support both during transit and while positioned over the back of a chair which is susceptible of a low cost of manufacture with regard to both materials and labor, and which accordingly is then susceptible of low prices of sale to the consuming public, thereby making such a backpack economically available to the buying public.

Another object of the invention is to provide a backpack providing lumbar support with pockets located between the primary and secondary back panels thereby providing a place for storing small objects or placing the user's hands when they're placed within the pockets while the backpack is worn.

Another object of the invention is to provide a backpack providing lumbar support with the potential of including a removable thermal gradient pad located within the lumbar support region which either can retain its warmth over an extended period of time or maintain a cooler temperature over an extended period of time.

Another object of the invention is to provide a backpack providing lumbar support with the potential of including vibrational generation within the lumbar support region through pressure sensitive activation.

Another object of the invention is to provide a backpack that while in the stationary mode provides a method of maintaining student alertness through random activation of vibrational generation.

Another object of the invention is to provide a multi-functional backpack with lumbar relief in both transit and while placed over the back of a chair with vibrational generation and a removable thermal gradient pad which is easy to use.

These together with other objects of the invention, along with the various features of novelty which characterize the invention, are pointed out with particularity in the claims annexed to and forming a part of this disclosure. For better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become more apparent when consideration is given to the following detailed description thereof. Such description makes reference to the annexed drawings wherein.

DETAILED DESCRIPTION OF A PREFERRED EMBODIMENT

Figure 1:
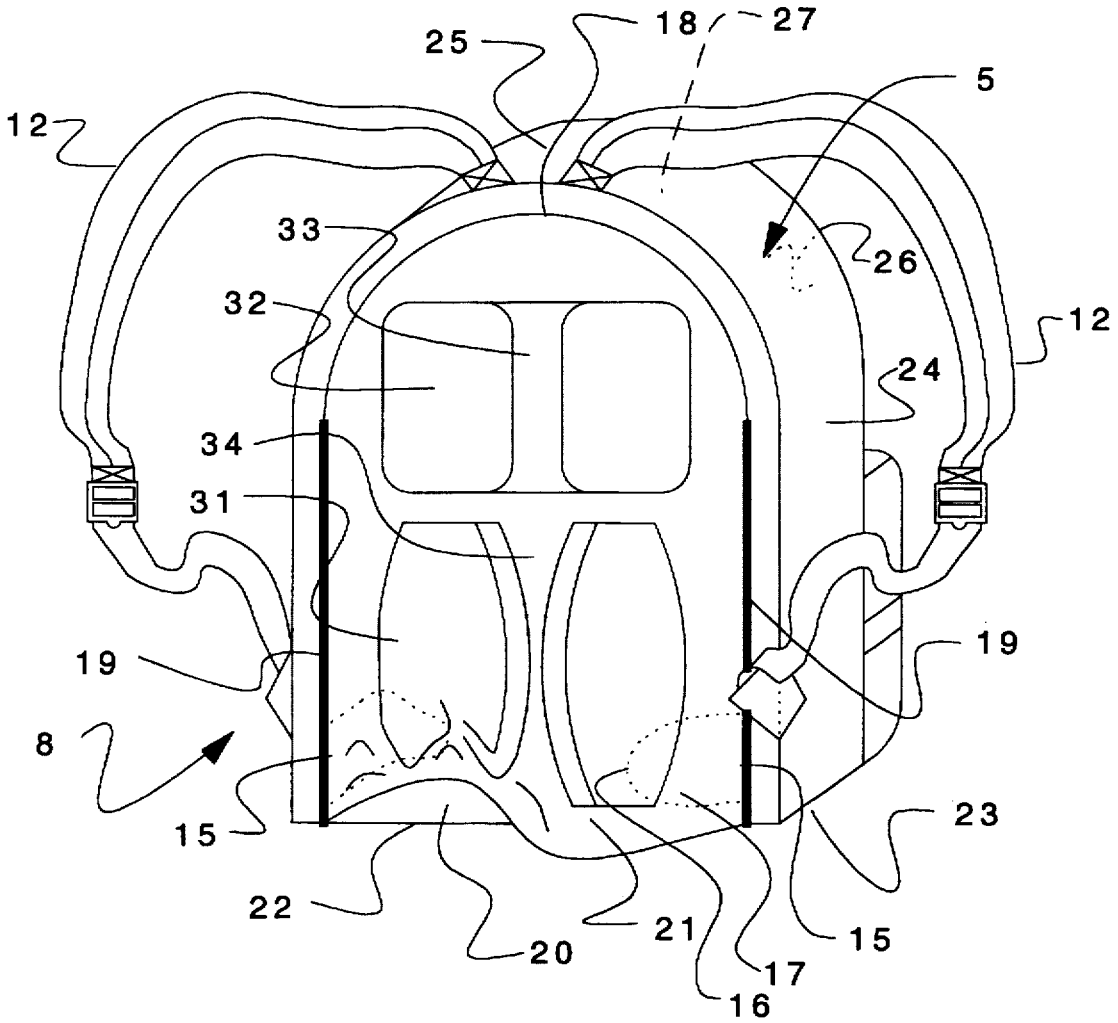
FIG. 1 is a schematic view showing the preferred embodiment of the invention.
Figure 2:
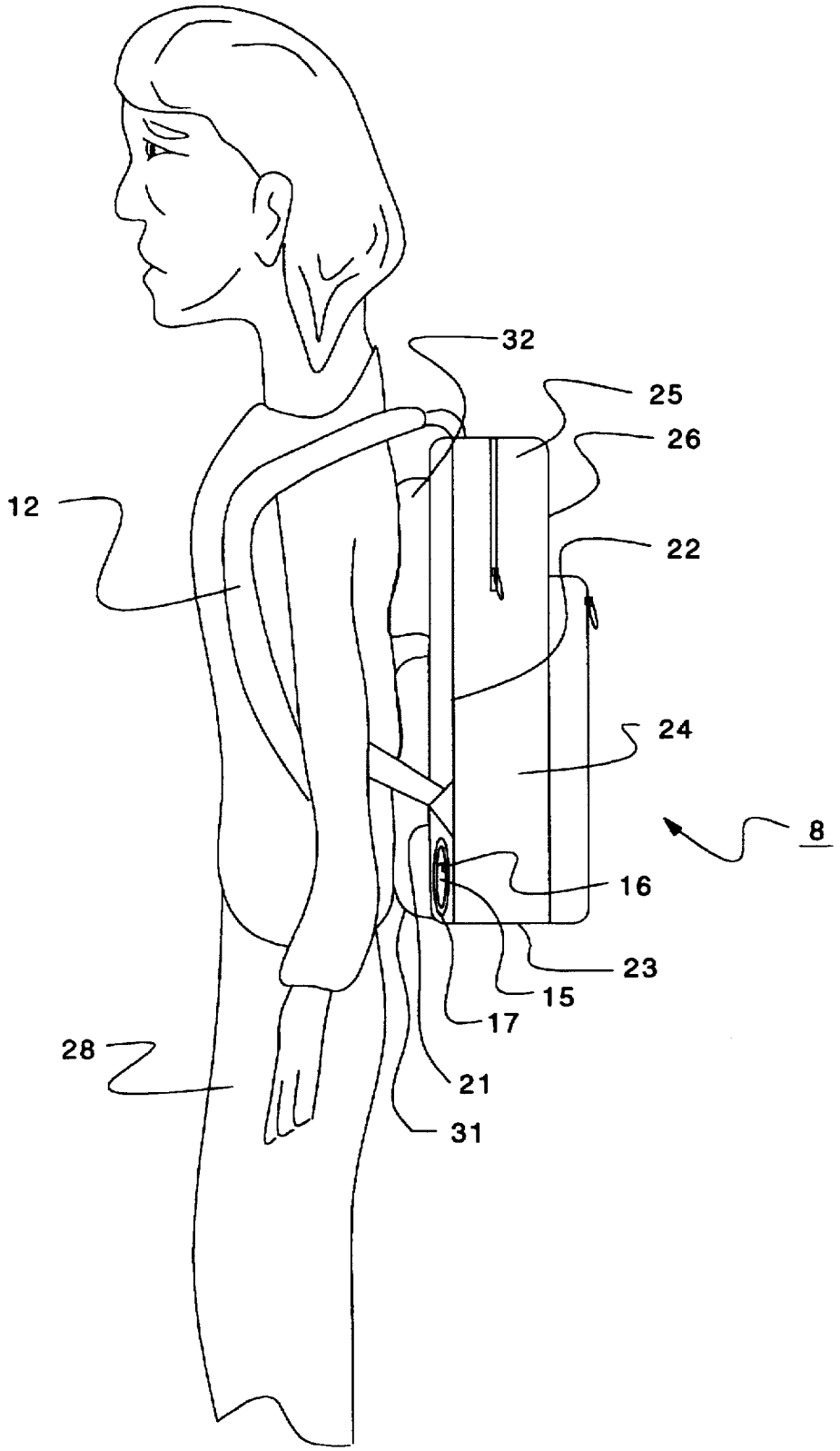
FIG. 2 is a side view illustrating the preferred embodiment of the invention as positioned on a person.
Figure 3:
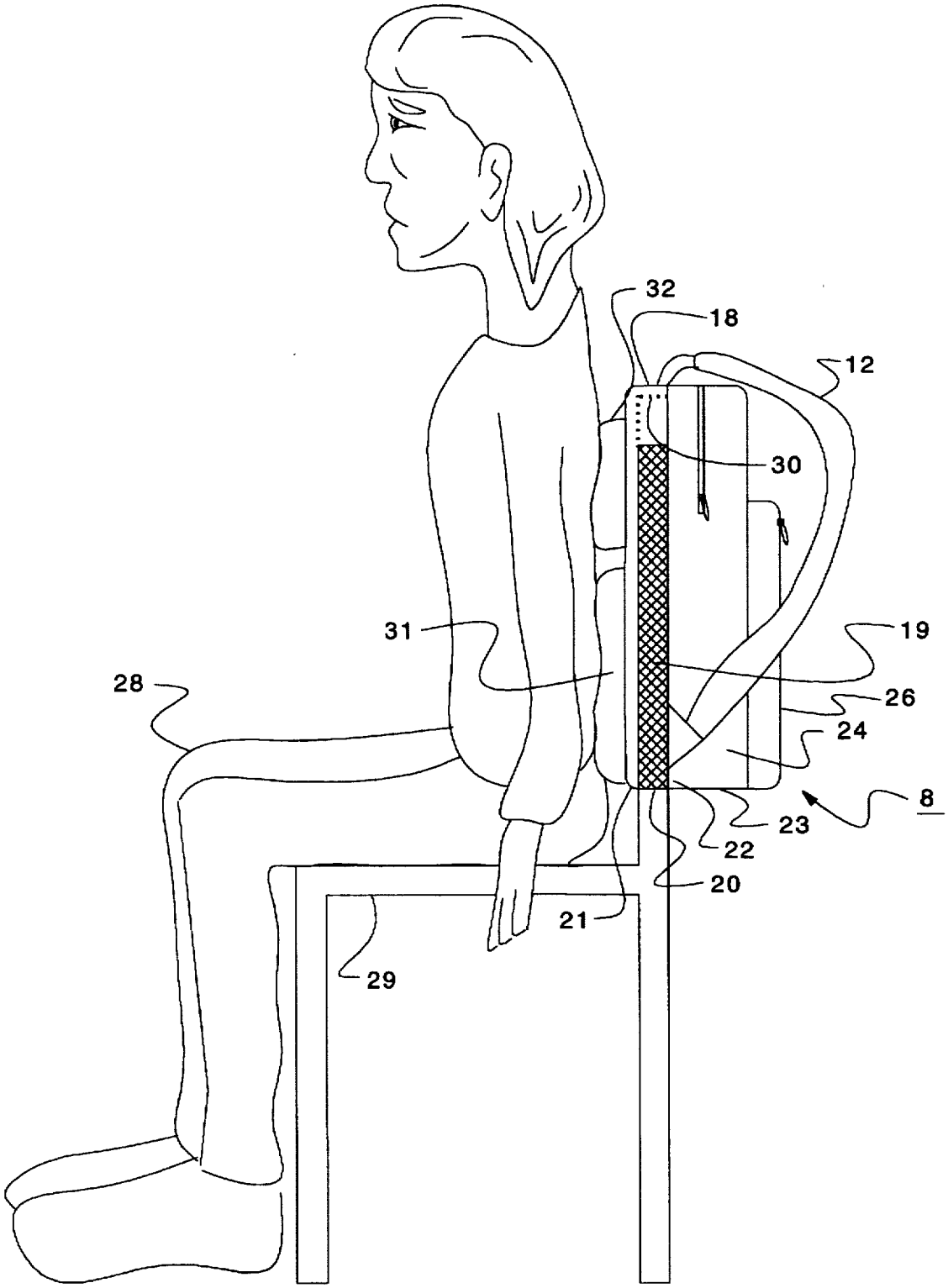
FIG. 3 is a side view similar to FIG. 2 but illustrating the preferred embodiment of the invention positioned over and supported by a chair.

With reference first to FIGS. 1 to 3, a preferred embodiment of the backpack assembly 8 of the present invention is shown. This invention comprises backpack 5 which includes a front panel 26, primary back panel 22, top panel 25, bottom panel 23 and two side panels 24. Furthermore, the front panel 26 and primary back panel 22 are secured together to form a chamber 27 within the panels of backpack 5. A zipper or other conventional means, provides selective access to chamber 27.

Still referring to FIG. 1, the backpack 5 includes a pair of shoulder straps 12. One strap 12 extends from the edge of the top panel 25 to one side or edge of the side panel 24. Similarly, the other strap 12 extends from the top panel 25 to the other side or edge of the side panel 24. Furthermore, as thus far described, the backpack 5 is conventional in construction. The back side of the backpack assembly 8 has two back panels, the primary back panel 22 and the secondary back panel 21 forming a pocket 20 in-between the back panels. The primary back panel 22 is securely attached to the secondary back panel along the top seam 18. The primary back panel 22 is joined elastically to the secondary back panel 21 along the edge seam 19 of both sides.

Referring to FIGS. 1–2, the pad assembly comprises an upper lumbar region 32 and a lower lumbar region 31. Each region is contoured for providing lumbar support to the corresponding region of the spine with upper lumbar relief 33 in pad 32 and lower lumbar relief 34 in pad 31.

The pads 31 and 32 are constructed of any conventional cushion material, such as foam rubber, neoprene or the like. Referring to FIG. 1, the pads 31 and 32 provide lumbar support to their respective regions of the spine of person 28 while the backpack 5 is worn in transit. In one embodiment of the preferred invention, an inner layer of material 16 is attached around its edges to an outer layer of material 17 forming a pocket 15 in between the primary back panel 22 and the secondary back panel 21. These pockets 15, one located on either side of the back region, are positioned towards the bottom side 23 of backpack 8.

Referring to FIG. 3, the pads 31 and 32 provide lumbar support to their respective regions of the spine of person 28 while the person 28 is seated in chair 29. When positioned in this manner, backpack 8 is placed over the back of chair 29 so that the pocket 20 formed between primary back panel 22 and secondary back panel 21 encompasses the back rest of chair 29 to the point where the top seam 18 of the backpack is in close proximity to the top portion 30 of the back rest of chair 29.

Figure 4:
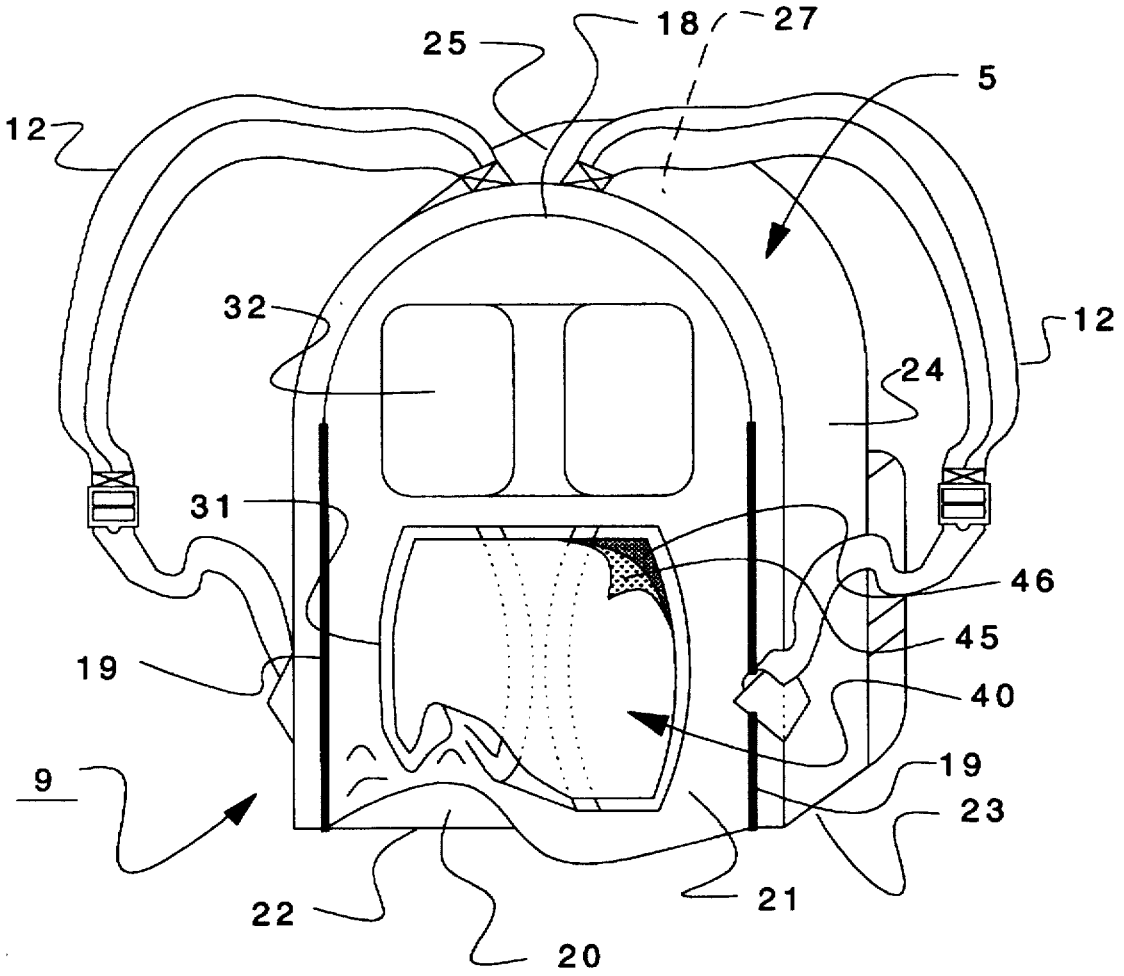
FIG. 4 is a schematic view of an alternate embodiment of the invention with the option of a removable heat pad attached by hook and loop type methods.
Figure 5:
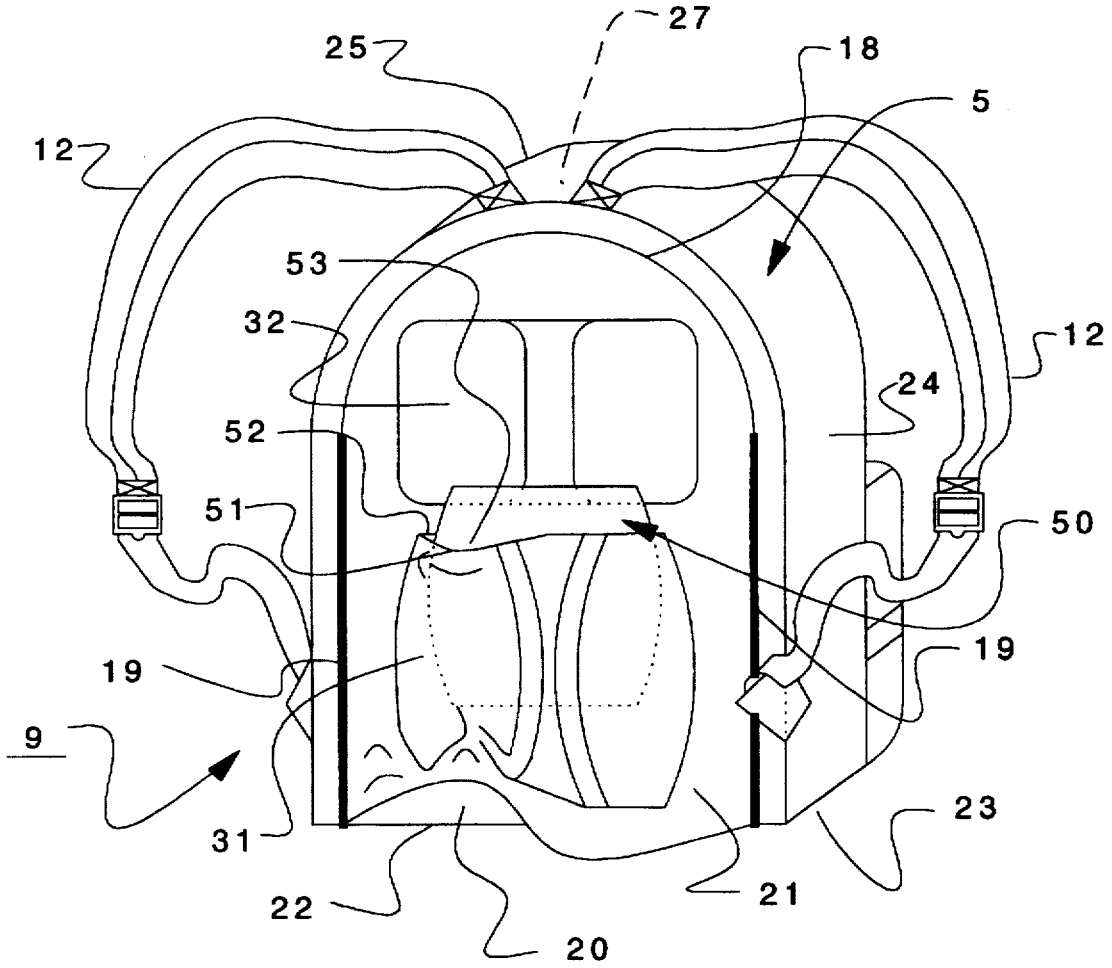
FIG. 5 is a schematic view of an alternate embodiment of the invention with the option of a removable heat pad which is housed in a lower lumbar pocket.

With reference to FIG. 4, an alternate embodiment 9 of the invention 8 contains heat pad 40 which is made of material which retains heat for an extended period of time. The material can be heated by many methods such as by microwaves. When heat pad 40 is positioned on the lower pad 31, heat will flow from heat pad 40 to the lower spine of person 28. The heat pad 40 provides for heat transfer predominantly away from backpack 5 and toward the lower spine region of person 28. FIG. 4 references a heat pad which has hook type material 45 on one surface of the heat pad 40 and the loop type material 46 attached to the lower pad region 31. This hook and loop type interface is similar in nature to the material known as VELCRO. FIG. 5 shows an alternate embodiment of backpack assembly 9. In this embodiment, lower lumbar pad 31 has outer material layer 51 attached to the secondary back panel 21 with the exception of opening 52 across the top region of lumbar pad 31 forming pocket 53 in-between. In this embodiment, heat pad 50 which is of similar material as heat pad 40 slides into pocket 53. The pocket 53 promotes heat transfer away from backpack 5 and toward person 28.

Figure 6:
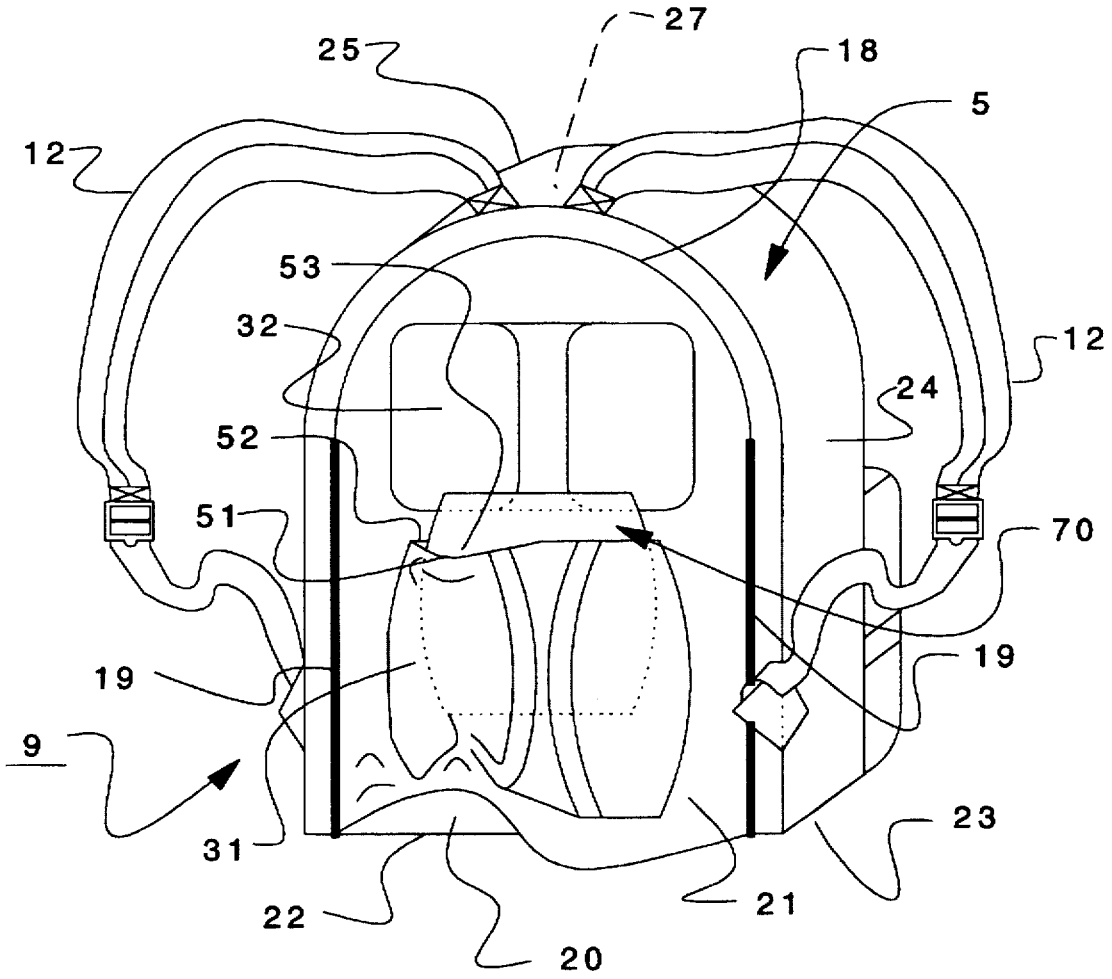
FIG. 6 is a schematic view of an alternate embodiment of the invention with the option of a removable cooling pad which is housed in a lower lumbar pocket.

A variation of this embodiment of the backpack assembly 9 is seen in FIG. 6. In this embodiment, lower lumbar pad 31 has outer material layer 51 attached to the secondary back panel 21 with the exception of opening 52 across the top region of lumbar pad 31 forming pocket 53 in-between. In this embodiment, pad 70 which is of material which retains a cool temperature for an extended period of time slides into pocket 53. The pad 70 can be filled with a liquid which can be frozen when placed in a frozen environment. The pocket 53 promotes the thermal gradient away from backpack 5 and toward person 28.

Figure 7:
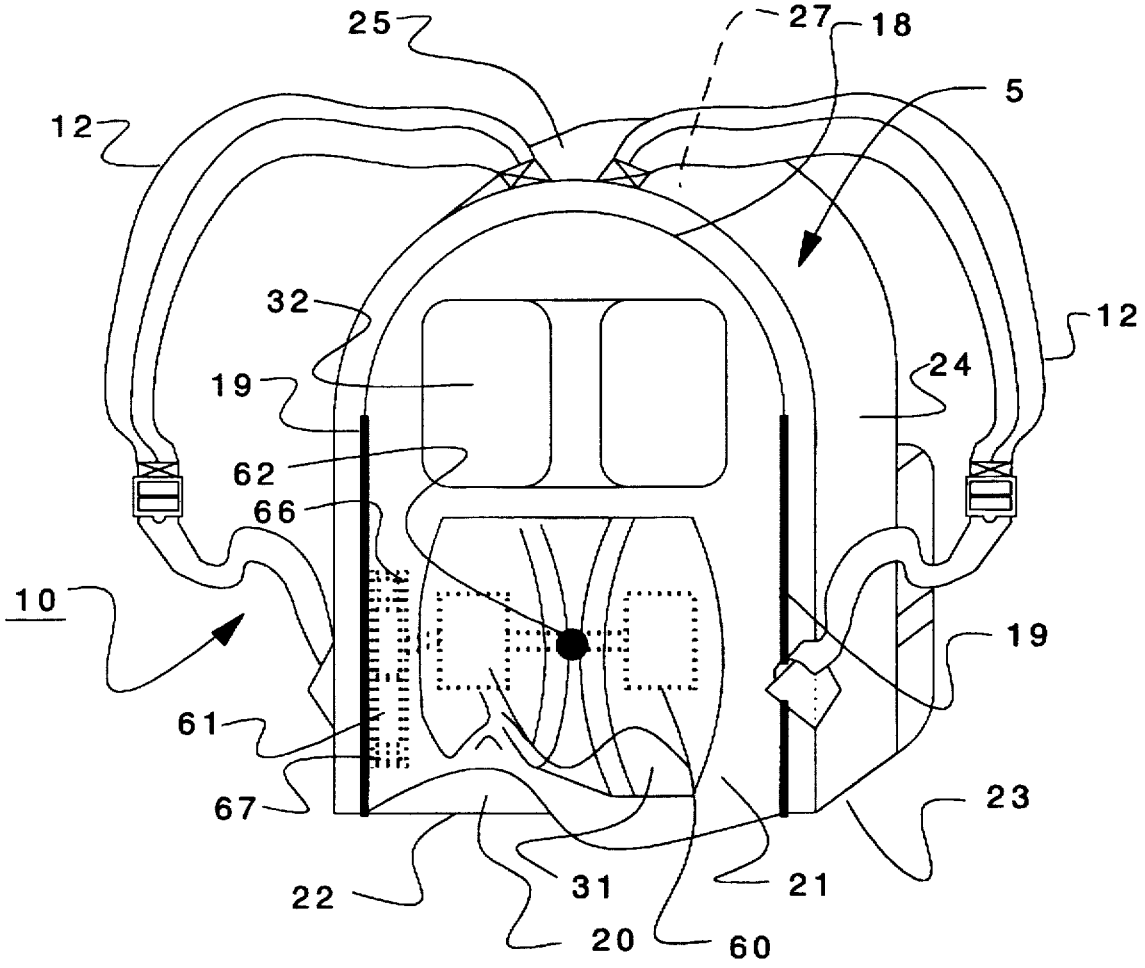
FIG. 7 is a schematic view of an alternate embodiment of the invention with means of vibrational generation.

With reference to FIG. 7, an alternate embodiment 10 of invention contains a motor 60 for delivering vibrational relief to the lower lumbar spine of person 28 through pad 31. The motor 60 is energized by a portable power supply 61 contained within housing 67 located in close proximity to motor 60. A pressure switch 62 located predominantly in the center region of lower pad 31 provides activation of the vibrational motor 60 when depressed or de-activation of the vibrational motor 60 when pressure switch 62 is not depressed. In one embodiment of backpack assembly 10, an on/off switch 66 provides direct activation or de-activation of the vibrational mechanism. In an additional embodiment of backpack assembly 10, the power supply is coupled to a microchip thereby producing vibration generation to the lumbar spine in a random operation mode. The random operation mode creates unanticipated lumbar vibrational relief to the lower spine region though pad 31.

With respect to the above description then, it is to be realized that the optimum dimensional relationships for the parts of the invention, to include variations in size materials, shape, form, function and the manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modification and equivalents may be resorted to, falling within the scope of the invention.

What is claimed is:

1. A backpack assembly adapted to be carried on the back of a person comprising a pack having a front panel, primary back panel and a chamber between said front and primary back panels having a top, a bottom and two sides, a secondary back panel secured to the primary back panel along the side and top portions forming a pocket between said primary back panel and secondary back panel, means for attaching said secondary back panel to said primary back panel, said means being elastic, and a pair of shoulder straps secured to said pack such that, with said straps positioned over the shoulders of a person, said front panel is generally parallel to the back of said person.

2. The invention as defined in claim 1 in which the top portion of the secondary back panel is securely fastened to the primary back panel and the side portions are elastically joined.

3. The invention as defined in claim 1 and comprising a lumbar support contained on the outer surface of the secondary back panel.

4. The invention as defined in claim 3 and comprising pockets on the edges of the backpack and located between the primary and secondary back panels.

5. The invention as defined in claim 3 and comprising a means for delivering thermal gradients disposed within the secondary back panel.

6. The invention as defined in claim 5 and comprising a means for generating vibration disposed within the lumbar region of the secondary back panel.

7. The invention as defined in claim 6 where said vibration generation means includes a motor secured within the lumbar region of the secondary back panel with a portable power source.

8. The invention as defined in claim 7 where said motor and power source is electronically coupled to a pressure switch for de-energization of said vibration generation in response to an absence of pressure applied to said pressure switch.

9. The invention as defined in claim 7 where said motor and power source is electronically coupled to a random mode switch for means of de-energization of said vibration generation in a random manner.

10. The invention as defined in claim 5 where said thermal gradient constitutes a removable heatable pad of said material which retains heat for an extended period of time when warmed.

11. The invention as defined in claim 10 where the removable heat pad is housed within a pocket.

12. The invention as defined in claim 10 where the removable heat pad is attached by hook and loop fastener material for releasable mating engagement.

13. The invention as defined in claim 3 where said thermal gradient constitutes a removable coolable pad of said material which retains cold temperatures for an extended period of time.

14. The invention as defined in claim 13 where the coolable pad is housed within a pocket.

15. The invention as defined in claim 3 and comprising a means for generating vibration disposed within the lumbar region of the secondary back panel.

16. The invention as defined in claim 15 where said vibration generation means includes a motor secured within the lumbar region of the secondary back panel with a portable power source.

17. The invention as defined in claim 16 where said motor and power source is electronically coupled to a pressure switch for de-energization of said vibration generation in response to an absence of pressure applied to said pressure switch.

18. The invention as defined in claim 16 where said motor and power source is electronically coupled to a random mode switch for means of de-energization of said vibration generation in a random manner.

* * * * *